United States Patent [19]

Hartig et al.

[11] 4,200,212

[45] Apr. 29, 1980

[54] PROCESS AND APPARATUS FOR CONVEYING INDIVIDUAL STRANDS INTO A COMPOSITE STRAND UNDER CONTROLLED SPEEDS AND TENSIONS

[75] Inventors: Wolfgang Hartig; Erich Lenk, both of Remscheid, Fed. Rep. of Germany

[73] Assignee: Barmag Barmer Maschinenfabrik AG, Remscheid-Lennep, Fed. Rep. of Germany

[21] Appl. No.: 22,181

[22] Filed: Mar. 20, 1979

[30] Foreign Application Priority Data

Mar. 20, 1978 [DE] Fed. Rep. of Germany ..... 2812100

[51] Int. Cl.[2] ..... B65H 25/24

[52] U.S. Cl. ..... 226/24; 226/42

[58] Field of Search ..... 226/24, 25, 42, 29; 57/58.7, 58.83, 90, 91, 93; 318/6; 242/47.01, 47.08

[56] References Cited

U.S. PATENT DOCUMENTS

| | | | |
|---|---|---|---|
| 3,160,802 | 12/1964 | Abell | 226/24 X |
| 3,781,953 | 10/1974 | Stegelman | 57/90 |
| 3,808,789 | 5/1974 | Hurley | 57/58.7 |
| 4,087,956 | 5/1978 | Gre | 57/58.7 |

*Primary Examiner*—Leonard D. Christian
*Attorney, Agent, or Firm*—John H. Shurtleff

[57] ABSTRACT

A process and apparatus for conveying a plurality of parallel individual strands into a composite strand, each individual strand being conducted between a delivery means and a draw-off means in common to all strands, all of the individual strands as well as the composite strand having adjustable speeds, wherein means are provided for measuring, comparing and controlling the speeds and tensional forces in the individual strands and in the composite strand to ensure a high quality plied or composite strand.

13 Claims, 3 Drawing Figures

PROCESS AND APPARATUS FOR CONVEYING INDIVIDUAL STRANDS INTO A COMPOSITE STRAND UNDER CONTROLLED SPEEDS AND TENSIONS

BACKGROUND OF THE INVENTION

The invention relates to a process and apparatus for the parallel conveyance of a composite strand with equal speed and tension in the individual strands, wherein each individual strand is conducted between its own delivery means and a draw-off means in common to all the strands and wherein speeds and tensions in the individual strands and in the composite strand are measured, compared and controlled.

The parallel conveyance of individual strands into a composite strand with equal speed and tension in the individual single strands is required for various industrial operations. In the synthetic fiber industry, for example, individually spun filaments, threads, or small bands are conveyed by godets, piled into a composite strand and wound. In the weaving and the knitting industries, various warp beams are manufactured from a plurality of individual strands as threads, yarns, filaments or the like. Also, filaments or threads conducted in parallel are often stretched by so-called warp-stretching or band-stretching devices. Other examples may be cited in the manufacture, processing and improving of metal wires in drawing machines, in heat-treatment processes or in the twisting or cabling of individual strands into a composite strand. Still another area of thread winding technology is that in which glass fiber rovings saturated with a hardenable or curable synthetic resin are wound according to a definite widing program onto a removable or collapsible core or liner so that high quality apparatus in the form of tubes can be produced with a low weight and very favorable strength properties.

In all these processes, it is important that the individual strands of the composite strand be conveyed, treated and/or wound with equal tension and with equal speed. Otherwise, sections in the composite strand may be produced in which only individual strands are tensioned while the rest lie loose and can even form loops. If such a composite strand is to transmit tensions or pulling forces, then only the tensioned or taut strands of the individual section can do this and, insofar as their elasticity permits, these taut strands are stretched until the rest of the individual strands are likewise pulled taut and can begin to take up the tensioning forces. With further stress, however, the breaking load is reached earlier for certain single strands of the composite strand. In such a composite strand, the total load capacity is thus considerably reduced unless all the individual strands are conveyed and combined with equal tension on each single strand.

Processes for compensating briefly occurring differences of tension in the parallel delivery or conveyance of strands, especially in the winding of threads onto a common, speed-controllable winding shaft, have been proposed according to various known embodiments, for example, as disclosed in U.S. Pat. Nos. 3,350,022 and 3,672,589 and also in the German published application (DE-AS) No. 2,247,474. The purpose of these known processes is always to compensate tension differences arising between the delivered individual strands, in their production or in a preceding treatment, for example, as caused by slightly varying working conditions in the spinning of filaments or in an after-treatment zone. These prior processes also control the common winding shaft over tension rolls, dancer arms or the like acting on each individual strand, in such a way that the differences in tension are compensated. By this process, the speed control of the winding shaft takes place either over a maximal or minimal thread tension on one of the yarns or also over a difference-limiting value between established tensions in the individual strands. It has been found to be disadvantageous in the known processes to control the speed in the composite strand because only one of the strands is used, namely the one which exceeds the prescribed tension difference-limiting value which then acts on the drive motor of the common winding shaft. As a result, the tension prevailing in each of the remaining individual strands is totally disregarded.

In the other processes wherein the drive motor of the common winding shaft is controlled by a maximally or minimally permissible tension on one of the parallel conveyed individual strands, a disadvantage arises because either a retardation or an inadmissible increase in the tension on one of the individual strands is not detected, and the control of the drive motor of the common winding shaft fails to respond. Both situations, i.e. either too much or too little tension, lead to operating disturbances and are associated either with strand breakage or the undesirable formation of so-called "winders" of individual strands at the delivery means. This is especially critical where the strand material presents only a slight capacity for compensating tension differences, i.e. for example, in the case of a fully drawn wire or an unannealed, brittle and poorly extensible strand material with a high modulus of elasticity, as well as in the case of relatively large variations in strand diameter caused by the processing conditions of the conveyed individual strands. In the case of wire strands with a diameter at the upper tolerance limit, e.g. due to wear of the drawing dies, an excess delivery or overfeed preferably takes place to avoid frequent breakage of individual strands. However, such an overfeed is not well controlled within precise limits.

SUMMARY OF THE INVENTION

It is an object of the present invention to provide a process and apparatus whereby the problems presented in the prior art are substantially avoided in conveying a number of parallel individual strands into a composite strand. The process of the invention offers a substantial improvement in measuring, comparing and controlling the speeds and tensions in all of the individual strands and also in the composite strand. The apparatus of the invention provides an improved means of conveying at least two or more strands into a composite strand under carefully controlled speeds and tensions, even when working at an essential predetermined speed of one or more of the individual strands as they are collected into said composite strand.

Such objects and advantages are achieved, in accordance with the present invention by a process for conveying a plurality of parallel individual strands into a composite strand, each individual strand being conducted between a delivery means and a draw-off means in common to all strands, all of the individual strands as well as the composite strand having adjustable speeds wherein the improvement for measuring, comparing and controlling the speeds and tensional forces in the individual strands and in the composite strand is essentially achieved by the steps which include measuring the difference between said composite strand speed and a first individual strand speed and controlling at least one of said composite or first individual strand speeds such that said difference is zero and measuring each difference between said controlled speed and each of all the other individual strand speeds and controlling those other individual strand speeds such that the tensional forces in all of the individual strands are equal. In this improved process, it is preferable to adjust the speed of the composite strand to the speed of the first individual strand and then adjust the speeds of each of the other individual strands to the speed of the composite strand. Moreover, it is preferable to establish a preset desired speed of a first preselected strand as between the composite strand and a predetermined individual strand and then to adjust the speeds of all the remaining strands either with reference to this preset speed or with reference to an actual speed compared to this preset speed.

These and other variations in the process together with suitable apparatus of the invention are explained and defined more fully in the following description and accompanying claims which are incorporated herein by reference to summarize the intended scope of the protection for the invention, including reasonable alternatives or equivalents. For example, it should be noted that the terms "strand," "wire," "thread," and the like as used in the singular or plural form are intended to be equivalent to each other whether directed to textile filaments, metallic wires, fiberglass rovings or other well-known filamentary materials.

In referring to a "predetermined individual strand," it will be understood that it is possible to select any one of the individual strands which are being drawn, conveyed or otherwise processed into a composite strand so as to serve as a primary control strand in adjusting actual speeds to the preset or desirable speeds for all of the individual strands as well as for the composite strand. Although there is preferably one preset or desired speed to which the other strand speeds are adjusted, it will be further understood that other individual strand speeds can be adjusted or controlled in response to the measurement of a speed condition or a tension condition in the strand itself, using a suitable feedback control system to adjust an actual speed to a desired speed.

THE DRAWINGS

The invention is illustrated more fully in the form of several preferred embodiments with the help of the accompanying drawings wherein similar parts or elements are designated by the same reference numeral and wherein the individual figures may be identified as follows:

FIG. 1 is a schematic representation of one process and apparatus of the invention for drawing off and plying three individual strands, illustrating the individual delivery means for the individual strands and a common draw-off means for the composite strand as well as automatic control devices for the various drive or delivery means according to the invention;

FIG. 2 is a schematic representative of another specific process and apparatus of the invention including delivery means and a winding or take-up means for the winding into a composite strand of two individual strands under equal speeds and tensions; and FIG. 3 is schematic representation of yet another embodiment of the process and apparatus of the invention wherein at least one individual strand is delivered from a processing interval, e.g. a drawing or stretching interval, and wound together with a second individual strand or set of individual strands, which are supplied from a run-off spool, coil, bobbin or the like so as to be wound together on a common winding or take-up spool under controlled equal speeds and tensions.

DESCRIPTION OF THE PREFERRED EMBODIMENTS

Figure 1:
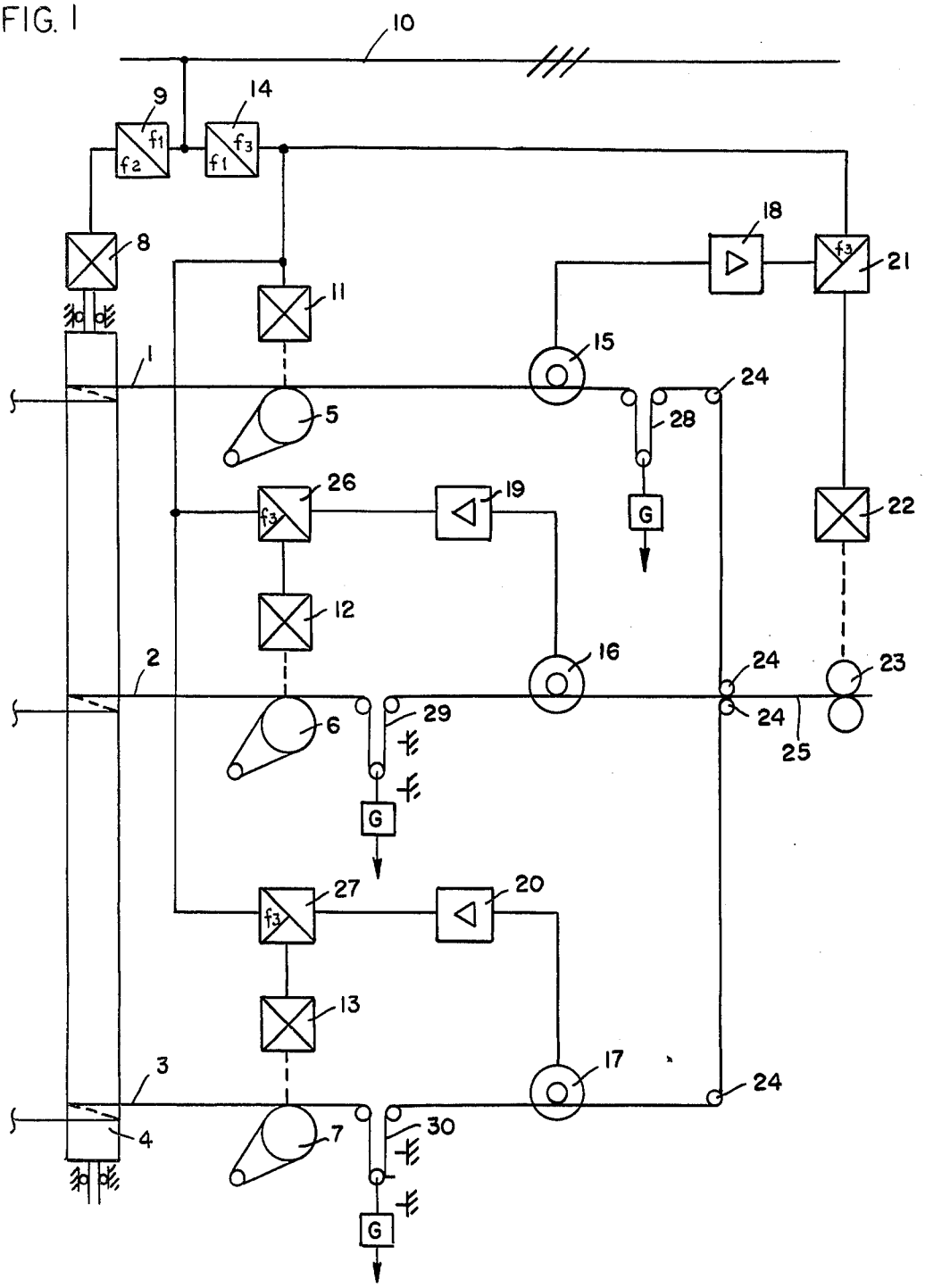

In FIG. 1, the individual wires or strands 1, 2 and 3 (for example, filaments, wires, cords, threads, yarns, rovings, small bands or similar substantially linear filamentary structures) are processed between the common feed roller 4 and the particular draw godets 5, 6 and 7 as draw means used to stretch the individual strands. In this stretching treatment, some slippage is permissible between the strands 1, 2 and 3 and the feed roller 4, for example, such that differing tensions may be present in the individual strands. The roller 4 is driven by the motor 8 via suitable gearing and a frequency changer 9 with power divider connected to electric-supply line or circuit 10. Individual motors 11, 12 and 13 drive the godets 5, 6 and 7, respectively. Motor 11 is regulated by an adjustable frequency changer with power divider 14 to run a preset, constant speed.

The conveyance or delivery speed of each individual strand 1, 2 and 3 is sensed by the tachometers 15, 16 and 17, which generate speed-dependent voltages as output signals. The output signals of the tachometers 15, 16 and 17 are fed through amplifiers 18, 19 and 20, respectively, and the other elements of the control system in the following manner.

The output signal of the tachometer 15, which represents the measured delivery speed of the individual strand 1, is fed through the amplifier 18 and delivered to the comparator-regulator device 21 where the amplified output signal is converted to a comparable frequency which is then compared with a preset frequency f3 from frequency changer 14. The difference in frequencies is represented by an output error signal which regulates the drive of the variable-speed motor 22. This motor 22 fixes the speed of the draw-off means 23 which may be constructed, for example, as a pair of pinch or nip rolls. These draw-off rolls 23, or similar means for advancing the composite strand, also provide a common drawing-off and conveyance of the individual strands 1, 2 and 3 as these are conducted to the draw-off rolls 23 by the deflecting guide rollers 24 for collection into the composite strand 25.

The individual strand 1 having a preset delivery speed, which in turn controls the speed of the motor 22 of the common draw-off means 23, is designated within the scope of the invention as the "predetermined individual strand." In principle, however, the individual strand 2 or 3 or any other individual strand being processed, where more than three are present, can be selected as the predetermined individual strand and the design or layout of the automatic control system correspondingly modified.

The output signals of the tachometers 16 and 17 are fed through amplifiers 19 and 20, respectively, and delivered to the comparator-regulator devices 26 and 27. The resulting amplified output signals are converted into comparable frequencies which are then compared in these comparator-regulator devices 26 and 27 with the preset frequency f3. Output error signals from comparator-regulator devices 26 and 27 subsequently supply power to motors 12 and 13, respectively, which in turn determine the delivery speeds of the godets 6 and 7. It will be obvious here that the comparison signal coming from the frequency changer and the speed-dependent actual value signal must be comparable or, if need be, previously transformed or converted into a comparable measurement value.

The draw-off speed of all the individual strands 1, 2 and 3 is determined, accordingly, by the delivery speed of the predetermined strand 1 through tachometer 15, amplifier 18 and motor 22. For adaption or adjustment to this draw-off speed, the delivery speeds of the individual strands 2 and 3 are measured by the tachometers 16 and 17, and the godets 6 and 7 are then speed-controlled by means of the amplifiers 19 and 20, comparator-regulator devices 26 and 27 and the motors 12 and 13, respectively.

The weight-loaded (G) storage devices 28, 29 and 30 are used for determining the tensions in the individual strands 1, 2 and 3 and then compensating for tensional variations or differences as between the individual strands in their particular paths or running courses by means of storing or releasing a loop or part of a loop formed in each individual strand. The storage and measuring device 28 is arranged in the path of the predetermined individual strand 1 between the tachometer 15 and the draw-off means 23, and likewise the corresponding storage and measuring devices 29 and 30 are each arranged in the paths of the individual strands 2 and 3 between the respective godets 6 and 7 and tachometers 16 and 17. If the storage and measuring devices 29 and 30 reach their greatest or least amount of storage capacity, end switches (not represented) can be actuated in order to vary the preset frequency input for the control of the motors 12 and 13 of godets 6 and 7, respectively, thereby permitting the storage and measuring devices to operate within the prescribed working range between the end switches. This design of the storage and measuring means permits a very sensitive and quick response of the control system to slight variations in speed and tension while avoiding any danger that the storage capacity will be exceeded during operation.

Figure 2:
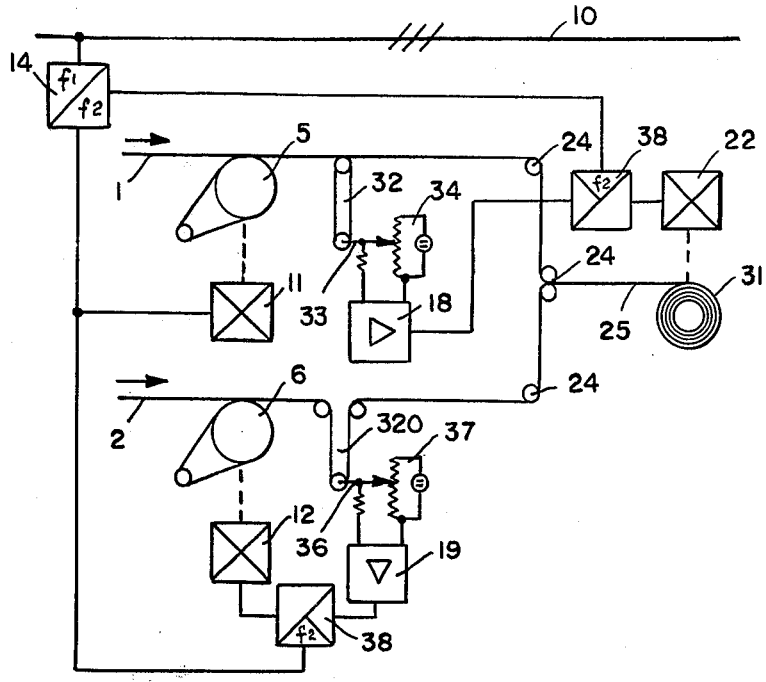

FIG. 2 is a schematic representation of an apparatus for winding two individual strands 1 and 2 supplied in common from a processing zone in the direction of the arrow. These individual strands are to be wound with equal speed and tension onto a draw-off means constructed in this case as a take-up spool or winder 31. The individual delivery godets 5 and 6 are again represented by the same reference numerals as in FIG. 1, these godets being driven by the variable speed motors 11 and 12, respectively, which are run from the electric supply line 10 through the adjustable frequency changer 14 having a power divider.

A comparison value for the delivery speed of the "predetermined individual strand" 1 is measured by the measuring device 32, for example, by using a storage arrangement as illustrated, wherein at least one complete loop of the strand 1 is stored around the upper and lower pulley rolls according to the block-and-tackle principle. The measuring sensor 33, depending on the position of the lower pulley roll, taps an electric voltage on the potentiometer 34 and delivers it to the amplifier 18, which is supplied by a separate current (not represented). The output signal of the amplifier 18 is received by the comparator-regulator device 38 connected to the electric current supply line 10 via frequency changer 14. The output of the comparator-regulator device 38 is thus used to control the drive motor 22 of the take-up spool 31. As seen in FIG. 2, any increase in speed or tension causes the sensor 33 to move upwardly with the lower pulley roll, and the resulting signal is amplified and transmitted to the comparator-regulator which acts to then reduce the speed of the motor 22 driving the common winder 31. If the speed of strand 1 decreases or its tension slackens, the same control sequence is followed, but in this case, the motor 22 is regulated to increase its speed driving the common winder 31. The braking or acceleration of the drive motor 22 is regulated by comparison of the frequency f2 from the frequency changer 14 in the comparator-regulator 38.

The strand 2 is provided along its path following the godet 6 with a similar measuring and storage device constructed as a dancer arm 320 for control of the drive motor 12 of the godet 6, depending on the tension arising in composite strand 25. The measuring sensor 36 connected with the dancer arm 320 varies its position depending on the tension present in the individual strand 2 so as to tap an electric voltage on the potentiometer 37 which is delivered to the amplifier 19. The output signal of the amplifier 19 is received by comparator-regular device 38 where it is converted into a comparable frequency and compared with the frequency f2 from frequency changer 14. An output error signal representing the difference between the frequencies provides power to control the drive speed of the motor 12 for godet 6.

The invention is thus realized in this case through the use of a first measuring and storage arrangement 32 to control the drive 22 of the draw-off means 31 and through the further use of a second measuring and storage arrangement 320 arranged in the path of the second strand to control the drive 12 of the allocated godet 6. This control depends on the tension in the composite strand and is accomplished by adjustment to the preset frequency input provided for the comparison.

Figure 3:
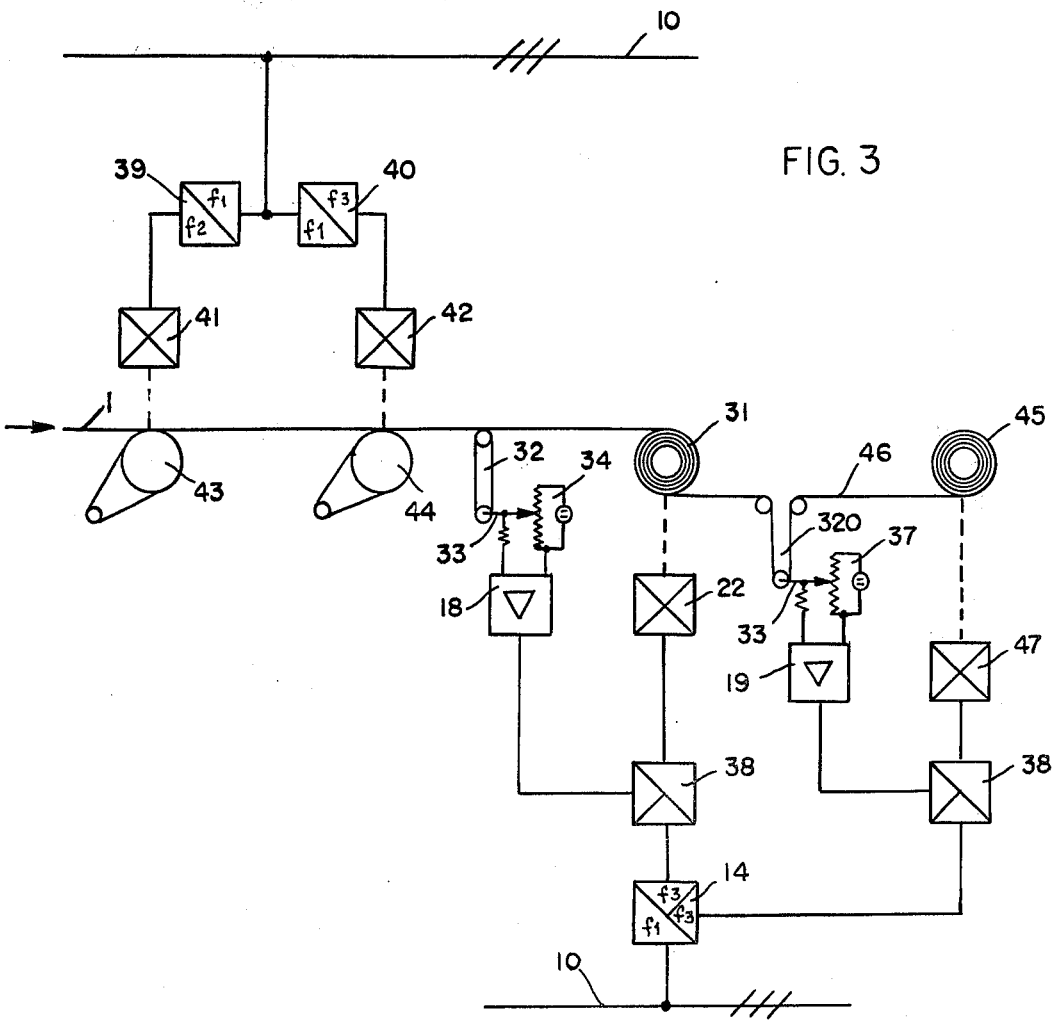

FIG. 3 schematically represents the automatic control of a specific wire treatment process, in particular a wire drawing process. In this process, the initially fed individual strand 1, for example, a wire for the production of a steel cord, is stretched between two or more paired feed and draw godets 43 and 44 driven at different speeds but motors 41 and 42, respectively. These speeds, with draw godet 44 being faster feed godet 43, correspond to the frequencies f2 and f3 preset to a fixed value by frequency changers 39 and 40. The electric supply line frequency is designated by f1. In the interest of simplicity, the drawing dies and other technical equipment required to complete the wire-drawing arrangements are not represented.

The take-up spool 31 in FIG. 3 is the draw-off means for the individual strand 1 after it has been stretched and is then drawn off and plied at equal speed and equal tension in common with a second predrawn wire 46 running off from a wire coil feed package 45. Here, the take-up spool 31 is controlled as in FIG. 2 by using a measuring arrangement 32 of a storage means in order to tap a voltage on the potentiometer 34 and then feed this voltage through the amplifier 18, the resulting amplified output voltage then being transmitted to the comparator-regulator device 38. There, the voltage measurement value as an amplified signal is converted into a comparable frequency signal and compared with the desired frequency value f3 from the frequency changer 14 with power divider, such that any given deviation or difference is used to adjust the draw-off speed of the composite strand by controlling the speed of the drive motor 22 for the take-up spool 31.

In a manner similar to the control means in FIGS. 1 and 2, the tension in the apparatus of FIG. 3 is measured in the "other" strand 46 as it is drawn off from the delivery or run-off spool 45, and the motor 47 of this run-off spool 45 is controlled in response to the winding speed of the composite strand on the take-up spool 31. The dancer arm 320 via sensor 33 taps an electric voltage on potentiometer 37 which is delivered to the amplifier 19. The output signal of amplifier 19 is received by comparator-regulator device 38 where it is converted to a comparable frequency signal which is then compared with the preset frequency from the frequency changer 14. The output error signal, representing the difference between the frequencies controls, the speed of drive motor 47 of the run-off spool 45, i.e. to increase or decrease this speed until the difference between the frequencies is zero.

It is also possible to apply a brake means to the wire run-off spool 45, depending on the required tension, and to operate this brake means provided with a control system in an analogous manner. Such an arrangement, however, is unfavorable for large feed spools 45 because of the large inertial forces which must be governed and the danger of possible wire deformations. It is therefore preferable to include all braking and acceleration means within the operation of the variable speed drive motor 47.

In FIG. 3 as well as in FIG. 1, several wires can be run-off and wound into the composite strand from speed-controlled, positively driven or braked run-off spools 45. Such plied wire or thread spools can then be fed to treatment or processing zones in which a common thermal, chemical and/or mechanical treatment takes place such as heat-treating, twisting, cabling or the like.

In adopting suitable automatic control apparatus to vary the speeds of the different strands in response to certain actual speeds or tensions differing from a desired preset value, it will be apparent that a number of different electrical or electronic systems may be interchanged to provide the required feedback or open looped control of the different strand speeds. In general, amplification of an error signal is necessary in such systems in order to improve reliability and speed of response.

As indicated in the preferred embodiments of FIGS. 1 and 2, a first predetermined individual strand is preferably used to control the draw-off speed for the composite strand, while simultaneously a measurable speed or tension is taken from the other individual strands to control the delivery speeds at a point lying farther back in the working direction, e.g. at the drive motor of the individual delivery means for the individual strands, while also taking into account the tensional forces in the composite strand in order to adjust these other delivered strand speeds individually to the draw-off speed of the composite strand.

According to the invention, it is therefore essential for only one "predetermined individual strand" to control the draw-off speed while each of the other individual strands provides a feedback to its own delivery means to control the delivery speeds of the rest of the individual strands in dependence on the adjusted draw-off speed of the composite strand. Alternatively, the draw-off speed can be preset as a reference input and the delivery speed of a "predetermined individual strand" can then be adjusted or matched to this reference input while the delivery speeds of the rest of the individual strands, through a sensing or measurement of the tensional forces of these other individual strands, are adjusted to the preset draw-off or conducting speed.

These principles are further developed according to the invention in such a way that speed differences in the individual strands are measured between the individual delivery mechanisms and the common draw-off mechanism and the actual speed measured in the predetermined one of the individual strands is adjusted to the preset or desired delivery speed, while the measured speed differences between the rest of the delivery means for the other individual strands and the common draw-off means are used in each case to control the delivery speeds of the respective individual strands.

By reason of the physical correlations, however, it is also possible with suitable measuring methods and control devices to control the speeds of the individual delivery means in dependence on the difference in each case between the delivery speed of the "predetermined" individual strand and the delivery speed of each "other" individual single strand. This results from the mathematical relations between the individual delivery speeds and the draw-off speed under the limiting condition that the draw-off speed of all the individual strands, i.e. of the composite strand, is necessarily equal so that this draw-off speed can be eliminated from the equalization system. This means, to be sure, that a certain draw-off speed must be established and controlled by a "predetermined" individual strand in correspondence to the desired reference input but with the understanding that this draw-off speed may generally be selected within a relatively broad range of optional and technically reasonable values. An essential precondition for the use of such a process, however, is that the individual strands all exhibit substantially the same diameter and preferably a very small diameter and that only slight tolerances of the thread or wire diameters are admissible.

Apparatus for carrying out the process of the invention need not be limited to those explained in detail hereinabove with the aid of the drawing. However, for all apparatus, it is essential that each individual delivery means equipped in each case with a speed-controllable drive motor or similar drive means also operates in conjunction with a common, speed-controllable drive motor for the draw-off means for the composite strand, and that between the delivery means and the draw-off means, there is provided a strand storage means equipped with a measuring device for determining the amount or strand stored at any moment. According to the invention, a storage means for a "predetermined" one of the individual strands preferably provides a control or output signal over its measuring or sensing means and through further operative members of an open-loop-control circuit in electrical connection with the drive motor for the common draw-off means, while each of the remaining measuring or sensing means as part of the storage device in the path of each "other" individual strand is functionally connected in each case with its own particular drive means operating its own allocated delivery godet or similar delivery means.

The storage means and their associated measuring means may be variously constructed and arranged. However, dancer arms are especially useful as measuring and storing arrangements. Other known storage arrangements may also be used in which the strand or filamentary material is wound a number of times around adjustably positioned rolls, corresponding to a block-and-tackle arrangement, where only small excursions or movements displacing these rolls produces relatively large changes in the amount of strand being stored.

FIGS. 2 and 3 indicate especially preferred areas of application for the use of the process and apparatus according to the invention. In particular, it has been found especially useful to employ such apparatus in the drawing of metallic wires or in similar drawing operations, e.g. as in FIG. 2 with the treated wires being drawn off by separately driven delivery means and wound onto a common winding carrier or take-up spool to form plied wire coil. Especially good results have also been achieved according to the wire drawing machine as shown in FIG. 3, wherein a first set of at least one strand is advanced from a drawing or stretching interval to join a second set consisting of a number of other predrawn wires taken from individual run-off coils, in order to wind both sets in common with equal speed and tension in all of the individual strands onto a common plying spool. The run-off coils or feed bobbins can be braked to control their speed only in dependence on the individual wire tension, but these run-off means are preferably individually driven by a variable-speed drive motor controlled by a dancer arm. The primary advantage of this latter arrangement resides in its capability of producing a plied coil or multiple wound spool in a single operation, it being necessary to look after a wire breakage only in a single drawing interval, i.e. without fear of sympathetic breakages in the parallel-engaged drawing intervals.

All of the processes and apparatus suggested for the present invention have the common advantage of permitting a precise and rapid control of both the speeds and tensions in the individually conducted or delivered strands as they are formed into a wide variety of plied or composite strands. Fewer thread breaks and a higher quality composite strand product are thereby ensured.

The invention is hereby claimed as follows:

1. In a process for conveying a plurality of parallel individual strands into a composite strand, each individual strand being conducted between a delivery means and a draw-off means in common to all strands, all of the individual strands as well as the composite strand having adjustable speeds, the improvement for measuring, comparing and controlling the speeds and tensional forces in the individual strands and in the composite strand which comprises:

measuring the difference between said composite strand speed and a first individual strand speed and controlling at least one of said composite or first individual strand speeds such that said difference is zero;

and measuring each difference between said controlled speed and each of all the other individual strand speeds and controlling those other individual strand speeds such that the tensional forces in all of the individual strands are equal.

2. The process as claimed in claim 1 wherein the speed of the composite strand is adjusted to the speed of said first individual strand, and the speeds of the other individual strands are adjusted to the speed of the composite strand such that the tensions in all of the individual strands are equal.

3. In a process for conveying a plurality of parallel individual strands into a composite strand, each individual strand being conducted between a delivery means and a draw-off means in common to all strands, the improvement for measuring, comparing and controlling the speeds and tensions in the individual strands and in the composite strand which comprises:

presetting a desired speed of a first strand which is selected as between said composite strand and a predetermined individual strand;

comparing and measuring the difference between said preset speed and the actual speed of said first strand;

controlling the speed of at least one of said composite and said predetermined individual strands such that the difference between said preset desired speed and the actual speed of said first selected strand is zero; and adjusting the speeds of the other individual strands to said preset speed such that the tensions in all of the individual strands are equal.

4. The process as claimed in claim 3 wherein the draw-off speed of the composite strand is adjusted to the preset delivery speed of a predetermined individual strand, and the delivery speeds of the other individual strands are adjusted to the speed of the composite strand such that the tensions in all of the individual strands are equal.

5. The process as claimed in claim 4 wherein the difference between the preset delivery speed and the actual delivery speed of the predetermined individual strand controls the draw-off speed of the composite strand, and the difference between said preset delivery speed of the predetermined individual strand and the actual delivery speeds of the other individual strands controls the individual delivery speeds of said other individual strands.

6. The process as claimed in claim 1 or 3 wherein the particular difference between said preset desired speed of said first strand and the actual delivery speed of each of said other individual strands in each case controls the individual delivery speed of each of said other individual strands.

7. An apparatus for conveying at least two individual strands into a composite strand under controlled speeds and tensional forces, said apparatus comprising:

a plurality of conveying means comprising individual delivery means having a speed-controllable drive means for each of said individual strands and a common draw-off means having a speed-controllable drive means for said composite strand;

a reference input means for presetting the speed of the drive means of a first conveying means, said first conveying means being a predetermined first individual delivery means for a first strand of said individual strands;

means for storing and measuring the stored portion of the individual strand located between each of said individual delivery means and said common draw-off means;

a first control means responsive to the stored portion of said first strand delivered by said first predetermined individual delivery means to control the speed of the drive of said common draw-off means; and additional control means allocated to each of the remaining individual delivery means of the other of said strands, said additional control means being responsive to the stored portion of its particular strand to control the speed of the drive means of its particular individual delivery means.

8. An apparatus for conveying at least two individual strands into a composite strand under controlled speeds and tensional forces, said apparatus comprising:

a plurality of conveying means comprising individual delivery means having a speed-controllable drive means for each of said individual strands and a common draw-off means having a speed-controllable drive means for said composite strand;

a reference input means for presetting the speed of the drive means of said common draw-off means;

means for storing and measuring the stored portion of the individual strand located between each of said individual delivery means and said common draw-off means; and control means allocated to each of the individual delivery means of said strands such that it is responsive to the stored portion of its particular strand to control the speed of the drive means of its particular individual delivery means.

9. The apparatus as claimed in claim 7 or 8 wherein the means for storing and measuring portions of an individual strand includes dancer arms together with means for storing at least one loop of said individual strand.

10. The apparatus as claimed in claim 7 or 8 wherein the common draw-off means is a take-up device on which said composite strand is wound.

11. The apparatus as claimed in claim 7 or 8 wherein the common draw-off means is positioned forwardly of a common strand treatment zone used for changing the properties of said individual strands.

12. The apparatus as claimed in claim 7 or 8 for producing plied wire spools in drawing machines including means for processing at least two wires in a single-stage or multistage drawing interval, separately driven delivery means for drawing off each of said wires from said drawing interval, and a common take-up winding means for said wires.

13. Apparatus as claimed in claim 7 or 8 for conveying a first set of at least one wire from a drawing machine and a second set of a plurality of predrawn wires from individual run-off spools and winding said sets together onto a common draw-off means to produce a plied wire spool, said apparatus comprising:

means to process said first set in a drawing interval of said drawing machine, including a constant drive delivery means for conducting each wire of said first set in the drawing interval;

storing and measuring means for said first set following said drawing interval to receive and store a portion of each wire and to measure the stored portion in its path between said drawing interval and said common draw-off means;

a speed-controllable drive means for said common draw-off means producing the plied wire spool;

control means responsive to the stored portion of a wire in said first set to control the speed of said common draw-off means;

a speed-controllable drive means to operate each of said run-off spools, including means to brake or accelerate each run-off spool;

individual storing and measuring means for each of said predrawn wires of said second set to receive and store a portion of each wire from its run-off spool and to measure the stored portion in its path between its run-off spool and said common draw-off means; and individual control means responsive to the stored portion of each predrawn wire in said second set to control its run-off speed by braking or acceleration of its run-off spool.

* * * * *

UNITED STATES PATENT AND TRADEMARK OFFICE

CERTIFICATE OF CORRECTION

PATENT NO. : 4,200,212

DATED : April 29, 1980

INVENTOR(S) : Hartig et al

It is certified that error appears in the above-identified patent and that said Letters Patent are hereby corrected as shown below:

In column 10, line 63, change "the drive of said" to --the drive means of said--.

Signed and Sealed this

*First* Day of *July 1980*

[SEAL]

*Attest:*

SIDNEY A. DIAMOND

*Attesting Officer*

*Commissioner of Patents and Trademarks*